US007059484B1

(12) United States Patent
Goldberg

(10) Patent No.: US 7,059,484 B1
(45) **Date of Patent: *Jun. 13, 2006**

(54) ADJUSTABLE MODULAR SHELF

(75) Inventor: Mark A. Goldberg, Lido Beach, NY (US)

(73) Assignee: Systemax, Inc., Port Washington, NY (US)

( * ) Notice: Subject to any disclaimer, the term of this patent is extended or adjusted under 35 U.S.C. 154(b) by 174 days.

This patent is subject to a terminal disclaimer.

(21) Appl. No.: 10/326,667

(22) Filed: Dec. 20, 2002

(51) Int. Cl.
*A47B 47/00* (2006.01)

(52) U.S. Cl. ..... 211/187; 211/181.1; 211/153; 211/147.11

(58) Field of Classification Search ..... 211/181.1, 211/187, 182, 153, 106, 90.01, 90.02–90.04; 108/147.11, 147.12, 147.13–147.17, 106, 108/107, 144.11; 248/243; D6/462, 465, D6/491–494, 481, 509–511, 574, 479, 566
See application file for complete search history.

(56) References Cited

U.S. PATENT DOCUMENTS

D215,773 S * 10/1969 Maslow ..... D6/462
3,523,508 A * 8/1970 Maslow ..... 108/147.13
3,757,705 A * 9/1973 Maslow ..... 108/147.13
4,064,994 A * 12/1977 Ondrasik, II ..... 211/153
4,595,107 A * 6/1986 Welsch ..... 108/147.13
4,627,543 A * 12/1986 Nicely ..... 211/187
4,629,077 A * 12/1986 Niblock ..... 211/187
4,637,323 A * 1/1987 Nicely ..... 108/107
4,750,626 A * 6/1988 Nicely ..... 108/192
D326,579 S * 6/1992 Leeds ..... D6/462
5,390,803 A * 2/1995 McAllister ..... 108/147.13
5,415,302 A * 5/1995 Carlson et al. ..... 108/147.13
5,676,263 A * 10/1997 Chang ..... 108/147.13
5,779,070 A * 7/1998 Dickinson et al. ..... 211/181.1
6,015,052 A * 1/2000 Goldberg et al. ..... 211/187
6,116,436 A * 9/2000 Ferrucci et al. ..... 108/181
6,253,933 B1 * 7/2001 Yang ..... 211/187
6,622,876 B1 * 9/2003 Goldberg ..... 211/181.1

* cited by examiner

*Primary Examiner*—Jennifer E. Novosad
(74) *Attorney, Agent, or Firm*—Gibbons Del Deo Dolan Griffinger & Vecchione

(57) ABSTRACT

A wire shelf includes at least four post supporting members each disposed at a respective corner of the wire shelf. A pair of end members is disposed at opposing ends of the wire shelf. Each of the end members is comprised of a truss having an upper wire and a lower wire. Each of the end members is joined at one end to one of the post receiving members and is joined at another end to another of the post receiving members. A pair of side members is disposed at opposite sides of the wire shelf. Each of the side members is joined at one end to one of the post receiving members that is joined to one of the end members and is joined at another end to another of the post receiving members that is joined to another of the end members. A plurality of wires is disposed atop and is joined to a top surface of the side members. At least one center support member is disposed between the side members and in parallel therewith. The center support member is comprised of a truss having an upper wire and a lower wire. The upper wire of the center support member is joined to each of the plurality of wires. The upper wire of the center support member is joined at one end to the upper wire of one of the end members and is joined at another end to the upper wire of another of the end members. The lower wire of the center support member is joined at one end to the lower wire of the one of the end members and is joined at another end to the lower wire of the another of the end members.

6 Claims, 5 Drawing Sheets

20
24
16
10
18
24
20
18
4
18
18
20
20
4
2
2

24
18
16
10
19
22
22
20
20
18
14
19
19
12

FIG. 4
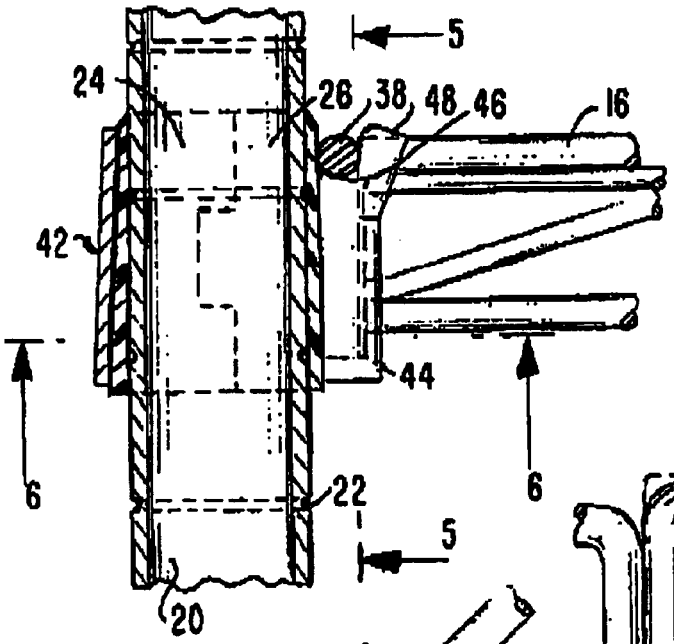
FIG. 5
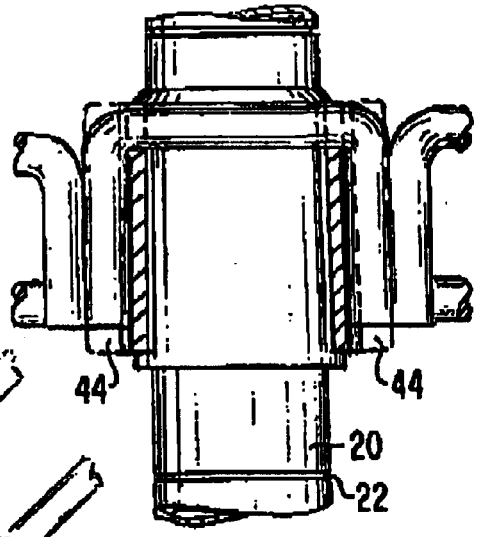
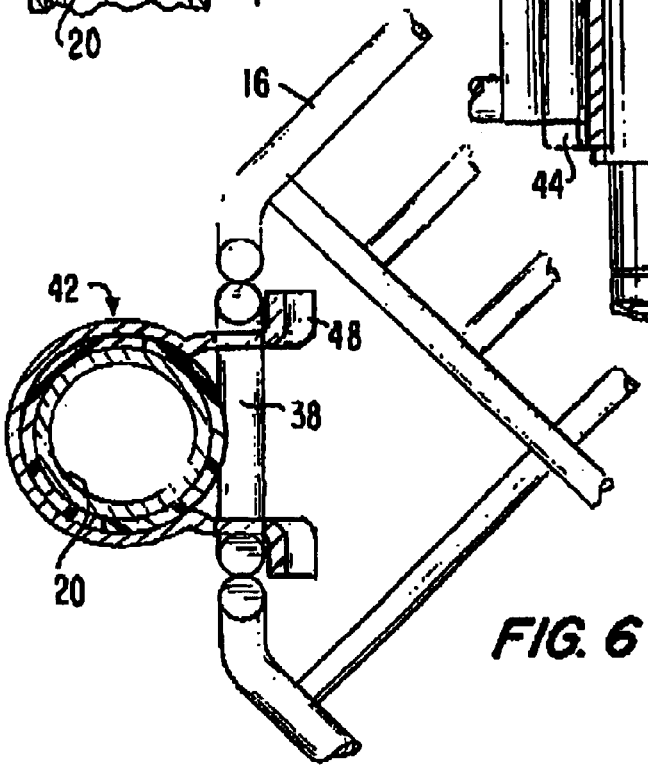
FIG. 6

ADJUSTABLE MODULAR SHELF

CROSS-REFERENCE TO COPENDING PATENT APPLICATIONS

U.S. Pat. No. 6,622,876, filed Oct. 25, 2001.

BACKGROUND OF THE INVENTION

1. Field of the Invention

The present invention is directed to shelving and, more particularly, to wire shelves for adjustable shelf systems.

2. Discussion of Related Art

U.S. Pat. No. 6,015,052, whose contents are incorporated herein by reference, reveals a modular shelving system. The present inventor is the named inventor of patent application U.S. Pat. No. 6,622,876, which is directed to a wire shelf for an adjustable shelf system.

The present inventor has discovered that the modular shelving system of U.S. Pat. No. 6,015,052 would benefit from applying the center truss revealed by U.S. Pat. No. 6,622,876 so as to strengthen the shelving to support greater weight.

It is therefore desirable to modify the modular shelving system of U.S. Pat. No. 6,015,052 so that the center region of its shelf may support greater weight loads.

SUMMARY OF THE INVENTION

The present invention modifies the subject matter of U.S. Pat. No. 6,015,052 so that a lower wire of the center truss extends at least to the perimeter of the shelf and is joined to the bottom of the shelf so that the shelf may support greater weight.

Other features and advantages of the present invention will become apparent from the following detailed description of the invention with reference to the accompanying drawings.

BRIEF DESCRIPTION OF THE DRAWINGS

The drawings of U.S. Pat. No. 6,015,052 and of U.S. Pat. No. 6,622,876 are incorporated herein by reference.

FIG. 4 is a fragmented, elevational view of the support post, support bracket collar and truncated corners of the shelving system shown in FIG. 1;

FIG. 5 is a sectional view taking along line 5–5 of FIG. 4;

FIG. 6 is a sectional view taking along line 6–6 of FIG. 4;

DETAILED DESCRIPTION OF THE INVENTION

The entire contents of the detailed description of the preferred embodiments of U.S. Pat. No. 6,015,052 and the detailed description of the invention of U.S. Pat. No. 6,622,876 are incorporated herein by reference.

The center support truss, as revealed in U.S. Pat. No. 6,622,876, is extended so that its bottom wire extends beneath and is joined to the end trusses of the modular shelving system of U.S. Pat. No. 6,015,052. In so doing, the shelf may support greater weight loads than without the center support truss being present. By providing more than one center support truss, the wire shelf of the invention may support even greater weight than with a single center support truss.

For definitional purposes, the following terms will be used for referring to the fully assembled system in normal use. The term "horizontal" refers to the direction parallel to a surface on which the assembled shelving system is supported in normal use. The term "vertical" refers to a direction substantially perpendicular to the horizontal direction. The term "base" refers to the end of the shelving system closest to the surface on which the shelving system is supported. The term "top" refers to the end opposite the base. The terms "front," "rear," "left side" and "right side" of the shelving system are relative terms as well be defined below.

Figure 1:
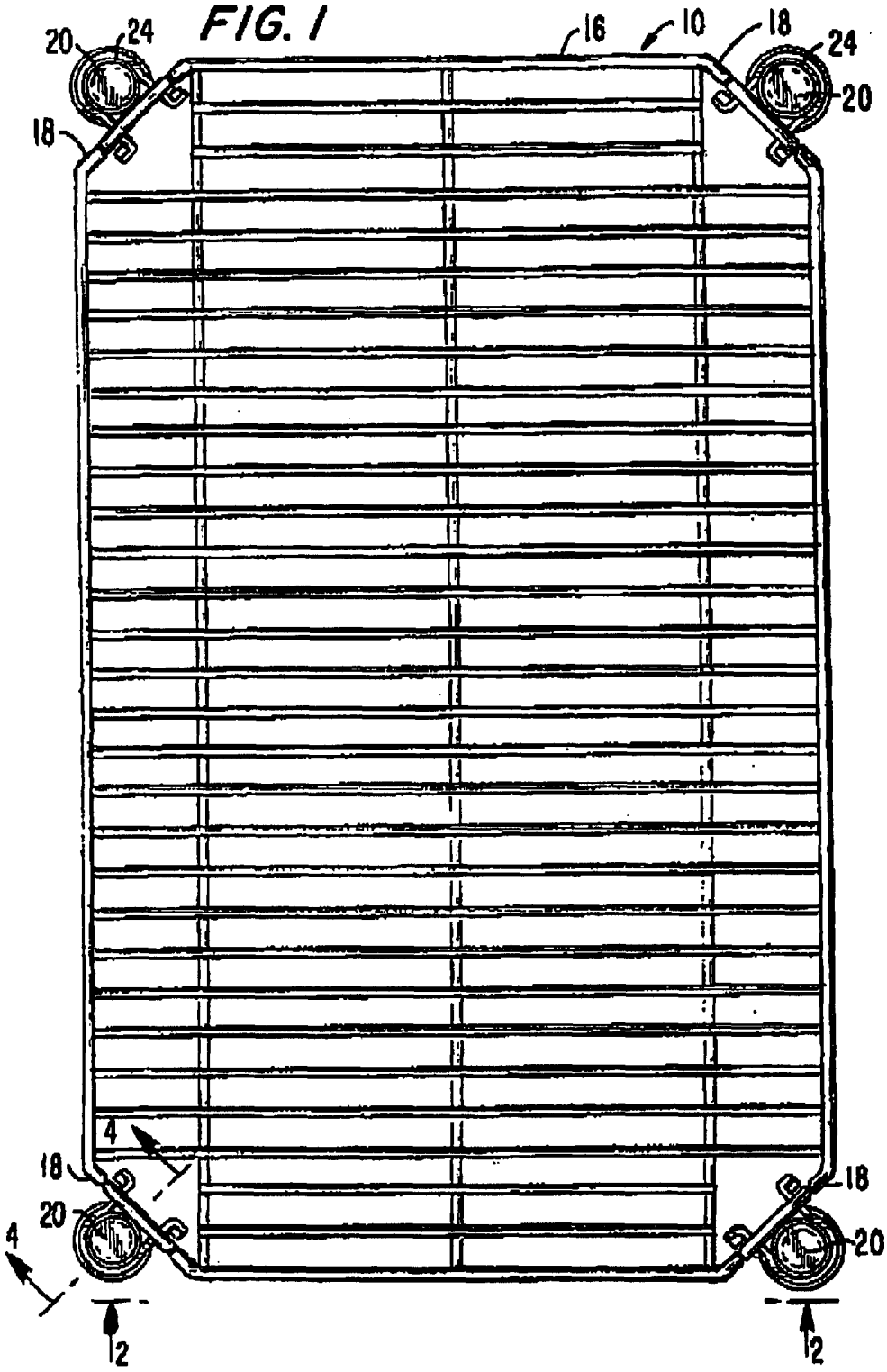
FIG. 1 is a top plan view of a shelf assembly in accordance with U.S. Pat. No. 6.015,052.
Figure 2:
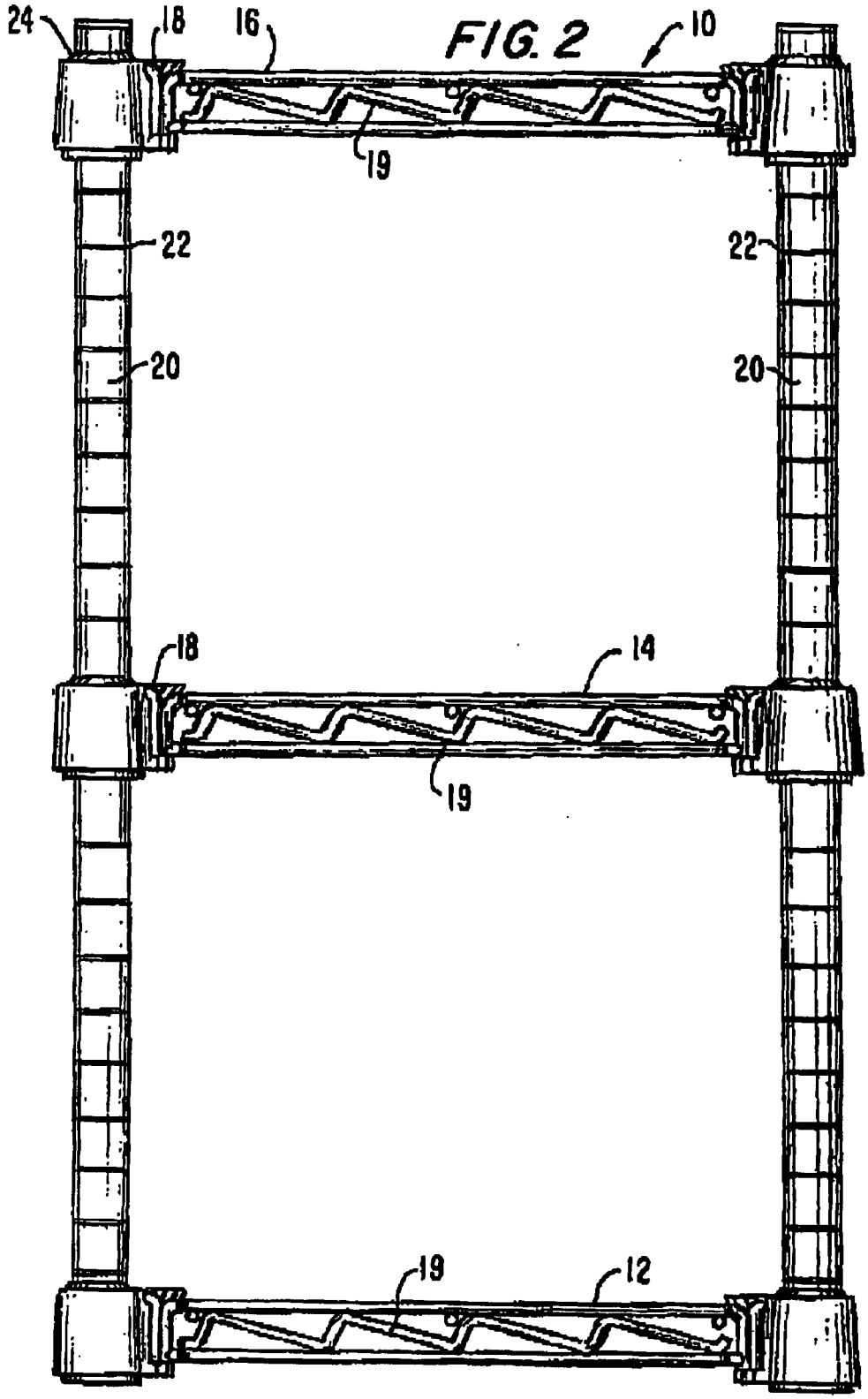
FIG. 2 is a side elevational view of the shelf assembly thereof.

Referring to FIGS. 1 and 2, which correspond to FIGS. 1 and 2 of U.S. Pat. No. 6,015,052, a shelving system 10 is disclosed. While system 10 will be described in detail below, it generally comprises a first polygonal frame assembly serving as a base assembly 12, a second identical frame assembly 14 serving as an intermediate shelf assembly and a top identical frame assembly 15. While shelf assembly 14 is denoted as intermediate it may be positioned anywhere between base shelf 12 and top shelf 16. Moreover, additional intermediate shelves 14 may be placed between base shelf 12 and top shelf 16. Shelf 16 includes truncated corners 18 as best shown in FIG. 2. Similarly, base shelves 12 and 14 have the same truncated corners, not shown.

Shelves 12, 14 and 16 are generally rectangular in shape and have a relatively long dimension running along the front and back and relatively short dimension running along the left and right sides of shelving system 10. A typical shelf assembly may have the dimension of 24" by 48" by 74". However, any size or shape of the shelves may be used. Shelves 12, 14 and 16 include snake trusses 19 which form the front and back thereof and extend essentially perpendicular thereto. Shelves 12, 14 and 16 as well as snake trusses 19 may be formed of bright basic steel. However, any number of wire sizes may be used depending on material cost, availability and the intended load of shelving system 10.

Figure 3:
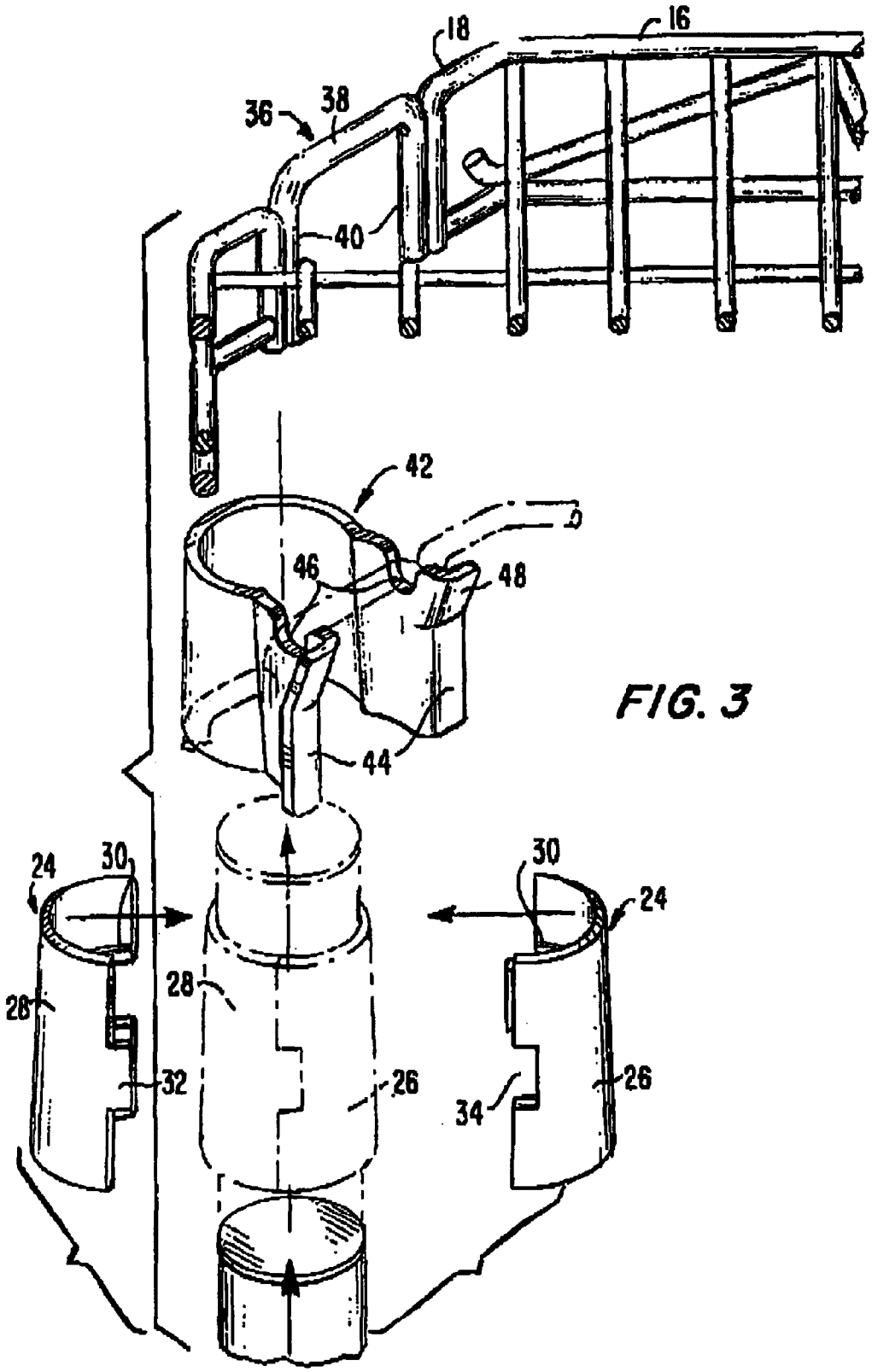
FIG. 3 is an exploded perspective view of the connecting members of the shelving assembly.

Truncated corners 18 of shelves 12, 14 and 16 include a bracket receiving section 36 as best shown in FIG. 3, which corresponds to FIG. 3 of U.S. Pat. No. 6,015,052, and are positioned between snake trusses 19. Bracket receiving section 36 includes a mounting section 38 at its top and two mounting sections 38 essentially perpendicular to bracket receiving section 36. The end opposite bracket receiving section 36 is open for receiving a bracket 42 as well be explained below in greater detail.

Shelves 12, 14 and 16 are supported by posts 20. In the preferred embodiment, four posts 20 are used so as to correspond to each truncated corner 18. Support posts 20 are generally hollow and are typically made of lightweight metal which provides high structural rigidity and are inexpensive to manufacture. Further, the materials should be resistant to corrosion and easily cleaned. A plurality of circumferential grooves 22, spaced apart at substantial regular intervals, are formed on support posts 20. Grooves 22 interact with collars 24, as will be described below in greater detail.

Collar 24 is formed with a first half 26 and a second half 28 as best shown in FIG. 3. First half 26 and second half 28 are joined together by interlocking tab assembly 32 and 34. On the interior of first half 26 and second half 28 of collar 24 is a lip 30. Lip 30 is positioned about the interior circumference of collar 24. Lip 30 is provided to interact with grooves 22 of post 20. When first half 26 is connected through interlocking tab assembly 32 and 34 to second half 28, collar 24 takes on a frustoconical shape. At the same time, lip 30 frictionally engages groove 22 so as to hold collar 24 in place. Each collar 24 is arranged so as to taper outwardly, when shelving system 10 is positioned in normal use. Collar 24 may be fabricated of any metal, but in the preferred embodiment, it is constructed using a plastic.

Bracket 42, as best shown in FIG. 3, is used to connect shelves 12, 14 and 16 to posts 20 and will be described below in greater detail. Brackets 42 are generally U-shaped with load support ends 44 extending from each end and are essentially perpendicular to the U-shaped portion of support bracket 42. At the top end of support bracket 42 is a shelf receiving section 46. Shelf receiving section 46 is shaped to fit mounting section 38 of bracket receiving section 36 of shelves 12, 14 or 16. In the preferred embodiment, shelf receiving sections 46 are semi-circular with notches 48 extending therefrom.

The assembly of shelving system 10 will now be described in connection with assembling base shelf 14 to posts 20. However, the same steps are repeated for intermediate shelf 14 and top shelf 16 or any othe shelves that are added therebetween.

To assemble shelving system 10, reference is made to FIGS. 3, 4, 5 and 6, which correspond to FIGS. 3, 4, 5 and 6, respectively, U.S. Pat. No. 6,015,052. Collars 24 are placed on posts 20 at the desired location. That is, each collar 24 is placed on a groove 22 on a corresponding post 20 at the same height so that shelf 12 will be level when assembled. To attach collar 24 to post 20, lip 30 of first half 26 and second half 28 are aligned with a groove 22 of post 20. The interlocking tab assembly 32 and 34 are then snapped together so that collar 24 securely fits around post 20 and is locked thereto through frictional engagement. The same step is repeated for each of the other three posts 20.

Support bracket 22 is next placed above collar 24 on post 20 then pulled toward the surface to a position as best shown in FIG. 5. The interior volume of support bracket 42, which takes on a modified frustroconical shape, is slightly greater than the frustroconical shape of collar 24 so that a friction fit is formed between the two parts. Support bracket 42 is pulled downward so that the top portion of collar 24 extends above support bracket 42. A support bracket 42 for each of the other three posts 20 are positioned in the same manner as described above.

Next, base shelf 12 is connected to posts 20 on support bracket 42. To make this connection, truncated corner 18 of base shelf 16 is aligned with support bracket 42. In particular, mounting section 38 of bracket receiving section 36 is aligned with shelf receiving section 46. Mounting section 38 is push downward into shelf receiving section 36. This step is repeated for each of the truncated corners 18 with respect to each corresponding support bracket 42. Once base shelf 12 is pushed downward, support wall 40 of bracket receiving section 36 rests against load support ends 44 as best shown in FIGS. 4 through 6. Notches 48 of support bracket 42 extend beyond mounting section 38 as shown in FIG. 4. This step is repeated for intermediate shelf 14 and top shelf 16.

To remove shelves 12, 14 and 16 from shelving system 10, each shelf assembly 12, 14 and 16 is lifted upward and away from the surface so that mounting section 38 of bracket receiving section 36 of truncated corners 18 are removed from shelf receiving section 46 of support bracket 42. Bracket receiving section 36 is then lifted in an direction away from the surface from collar 24 and is removed. Interlocking tab assemblies 32 and 34 are then released so that collar 24 may be removed. Based thereon, an inexpensive, lightweight vertical shelving system capable of being very easily assembled and disassembled is provided.

Moreover, the shelving assembly 10 could be designed so that any number of the shelves could be fix to posts 20 in a manner well known in the art, for example, that described in U.S. Pat. Nos. 3,424,111; 3,523,508; and 3,757,705. The user could then use the adjustable shelving mechanism, as described herein, using shelves 12, 14 or 16 with truncated corners 18 together with collars and support bracket 42. In this manner, shelving assembly 10 would have a combination of fixed shelves and adjustable shelves. Alternatively, shelving system 10 could be contain a plurality of adjustable shelves as shown in FIGS. 1 and 2.

All specific shapes, dimensions, wire sizes, number of shelves and materials mentioned herein are provided by way of example only. Shelving systems fabricated in shapes, dimensions and using different wire sizes and materials and having a different number of shelves other than those discussed and illustrated herein also are contemplated.

Figure 7:
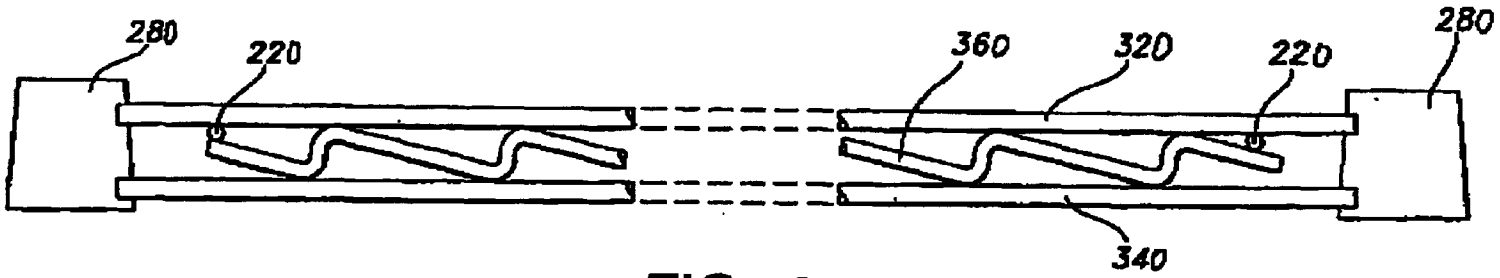
FIG. 7 is an end view of portions of a wire shelf of U.S. Pat. No. 6,622,876.

FIG. 7, which corresponds to FIG. 3 of U.S. Pat. No. 6,622,876, shows the structure of the end trusses 230 and 240, as well as the post supporting members 280 in greater detail. The end trusses are constructed of a top wire 320, a bottom wire 340, and a corrugated wire 360 that is welded to the top wire 320 and the bottom wire 340 at various locations. The ends of the top wire 320 and bottom wire 340 are welded to the post supporting members 280. The post supporting members 280 are ring shaped, but have a conical cross section. The support wires 220 are each welded at their ends to the top wire 320 of the end trusses.

Figure 8:
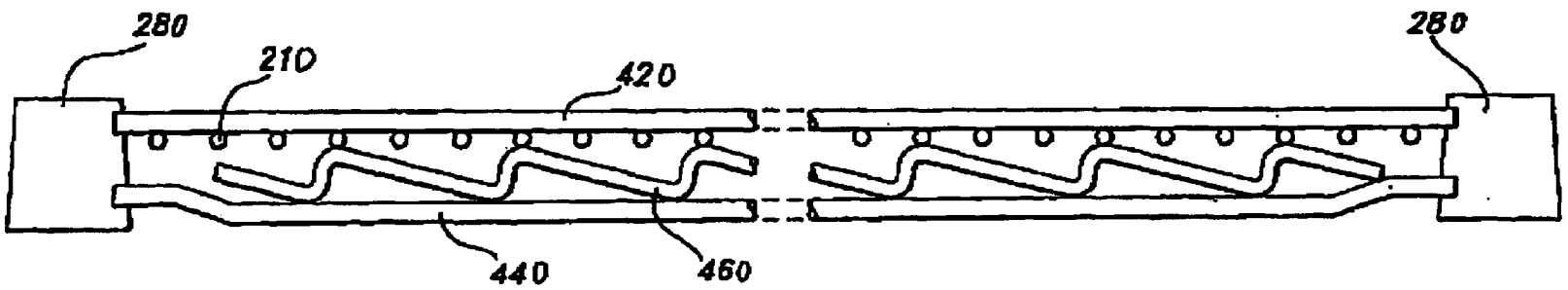
FIG. 8 is a side view of portions of the wire shelf of FIG. 7.

FIG. 8, which corresponds to FIG. 4 of U.S. Pat. No. 6,622,876, illustrates the structure of the side trusses 260 and 270 in greater details. Each side truss is constructed of a top wire 420 and a bottom wire 440. The plurality of shelf wires 210 are each welded to an underside of a top wire 420. A corrugated wire 460 is disposed between the top wire and the bottom wire and is welded at its bends to the bottom wire 440 and to some or all of the shelf wires 210. The ends of the top wire 420 and the bottom wire 440 are welded to the post supporting members 280.

Although the present invention has been described in relation to particular embodiments thereof, many other variations and modifications and other uses may become apparent to those skilled in the art. It is preferred, therefore, that the present invention be limited not by this specific disclosure herein, but only by the appended claims.

What is claimed is:

1. A shelving system, comprising:

a polygonal shelf assembly having at least three bracket receiving sections and opposing ends and opposite sides;

at least three shelf supporting assemblies for supporting said polygonal shelf assembly;

at least three posts being releasably coupled to said at least three shelf supporting assemblies for supporting said polygonal shelf assembly;

each of said shelf supporting assemblies including a collar and a support bracket, said support brackets having a shelf receiving section, each of said collars being frictionally coupled to said at least three posts, each of said support brackets being frictionally engaged to said collars, said at least three bracket receiving sections of said polygonal shelf assembly being releasably coupled to said shelf receiving sections of said support brackets;

a pair of end members disposed at the opposing ends of said polygonal shelf assembly, each of said end members being joined at one end to one of said collars and being joined at a further end to a further of said collars;

a pair of side members disposed at the opposite sides of said polygonal shelf assembly, each of said side members being joined at one end to the one of said collars and being joined at another end to the further of said collars;

a plurality of shelf wires disposed spaced from each other and being joined to said side members; and at least one center support member truss disposed between said side members and in parallel therewith and joined to both of said end members, said center support member truss having a truss wire joined to each of said plurality of shelf wires;

wherein said end members each have an end truss wire and a further truss wire, said center support member truss wire being joined to each of said end members;

said center support member truss having another wire joined to said further wire of each of said end members.

2. A shelving system as in claim 1, wherein each of said at least three posts includes a plurality of substantially circumferential grooves spaced at essentially regular intervals therealong;

said collars of said shelf supporting assemblies including a substantially circumferential lip in the interior surface for frictional engagement with the circumferential grooves of said posts.

3. A shelving system as in claim 1, wherein said polygonal shelf assembly is substantially rectangular and includes substantially truncated corners, each of said truncated corners including said bracket receiving sections.

4. A shelving system as in claim 3, wherein said support brackets are generally U-shaped and include a shelf receiving section and load support ends, said load support ends extending essentially from each of the ends of said U-shaped support brackets; and said bracket receiving section of said shelf assembly extending substantially perpendicular to said shelf assembly and including a mounting section and at least two support walls, said mounting section being essentially parallel to said shelf assembly and said two support walls being substantially perpendicular to said shelf assembly, said mountings section of said bracket receiving section being releasably coupled to said receiving section of said support brackets and said two support walls being rested against said load support ends of said support brackets.

5. A shelving system as in claim 1, wherein:

said at least three posts include plurality of substantially circumferential grooves spaced at essentially regular intervals therealong, said collars of said shelf supporting assemblies including a first part and a second part, the first part being releasably coupled to said second part to form a frustroconical shaped collar the interior portion of said first and second parts includes a substantially circumferential lip surface for frictional engagement with the circumferential grooves of said posts;

said polygonal shelf assembly being substantially rectangular and including substantially truncated corners, each of said truncated corners including said bracket receiving sections;

said support brackets being generally U-shaped and including a shelf receiving section and load support ends, said load support ends extending essentially from each of the ends of said U-shaped support brackets; and said bracket receiving section of said shelf assembly extending substantially perpendicular to said shelf assembly and including a mounting section and at least two support walls, said mounting section being essentially parallel to said shelf assembly and said two support walls being substantially perpendicular to said shelf assembly, said mounting section of said bracket receiving section being releasably coupled to said receiving section of said support brackets and said two support walls being rested against said load support ends of said support brackets.

6. A shelving system as in claim 1, wherein toe center support member truss includes a corrugated wire between another wire of center support member truss wire and said center support member truss wire, the corrugated wire being joined to another wire of said center support member truss wire and said center support member truss wire at a plurality of spaced apart locations, another wire of said center support member truss wire and said center support member truss wire being spaced apart from each other.

* * * * *